US006354873B1

(12) United States Patent
Morello et al.

(10) Patent No.: US 6,354,873 B1
(45) **Date of Patent: *Mar. 12, 2002**

(54) SNAP RAIL AND CONNECTOR BODY COMBINATION

(75) Inventors: John R. Morello, Warren; John A. Yurtin, Southington; Jon C. Hobbs, Burghill, all of OH (US)

(73) Assignee: Delphi Technologies, Inc., Troy, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/240,739

(22) Filed: Jan. 29, 1999

(51) Int. Cl.[7] ..... H01R 13/40

(52) U.S. Cl. ..... 439/595; 439/352; 439/752; 439/848

(58) Field of Search ..... 439/595, 752, 439/848, 748, 346, 352, 353, 357

(56) References Cited

U.S. PATENT DOCUMENTS 4,690,477 A * 9/1987 Doutrich et al. ..... 439/595
4,705,337 A * 11/1987 Maeda ..... 439/595
5,525,077 A * 6/1996 Badaroux ..... 439/595
5,738,543 A * 4/1998 Rollins et al. ..... 439/595
5,820,410 A * 10/1998 Genta et al. ..... 439/595
5,885,106 A * 3/1999 Genta et al. ..... 439/595

* cited by examiner

*Primary Examiner*—P. Austin Bradley
*Assistant Examiner*—Truc Nguyen
(74) *Attorney, Agent, or Firm*—Thomas A. Twomey

(57) ABSTRACT

A snap rail pivotally connected to a connector body for providing simultaneous actuation of button locks of connector pins discretely received within respective connector receptacles of the connector body. The connector body has a plurality of connector receptacles arranged side-by-side horizontally, each having a primary lock composed of a first engagement feature for interferingly engaging a second engagement feature of a respective connector pin seated therein. The connector pins have an abutment feature for secondarily restraining it from axial movement in the connector receptacle in response to a tip of a button lock being received into the respective connector receptacle. An upper side of the connector body is provided with a plurality of button ports, one button port respectively for each connector receptacle, wherein the respective button lock enters therethrough and the tip thereof interferingly engages the abutment feature. The button lock and the abutment feature collectively provide a secondary lock for each connector pin in its respective connector receptacle. Each of the button locks is connected to the snap rail so that the tip thereof adjoins its respective button port when at an undeployed state of operation, and is fully received thereinto when at a deployed state of operation. Only the button locks at a central portion of the snap rail snappingly engage the connector body when at the deployed state of operation.

10 Claims, 3 Drawing Sheets

SNAP RAIL AND CONNECTOR BODY COMBINATION

TECHNICAL FIELD

The present invention relates to connector bodies for providing a predetermined alignment of a plurality of connector pins. More particularly, the present invention relates to a connector body having a snap rail feature for providing simultaneous secondary locking of all the connector pins received therewithin.

BACKGROUND OF THE INVENTION

Connector bodies are utilized for facilitating electrical connections at various junctures of electrical systems. In this regard, each connector pin of a plurality of connector pins is uniquely received in a respective connector receptacle of the connector body, wherein each connector pin enters its respective connector receptacle from a rearward end of the connector body and, upon being fully seated, is held therein by a primary lock. A secondary lock is then actuated to assure the connector pin remains seated in its respective connector receptacle. An example of a secondary lock is a button lock is depressably pushed through an aperture in the connector body so that an abutment feature thereof interferingly engages a respective connector pin to thereby secondarily restrain axial movement of the connector pin in its respective connector receptacle. In this regard, each button lock of a plurality of button locks must be independently depressed.

Accordingly, what remains needed in the art, is a connector body having a secondary lock mechanism for connector pins which is easy and simply operated and is actuated for a plurality of connector pins simultaneously.

SUMMARY OF THE INVENTION

The present invention is a snap rail pivotally connected to a connector body for providing simultaneous actuation of button locks of connector pins discretely received within respective connector receptacles of the connector body.

The connector body according to the present invention has a plurality of connector receptacles arranged side-by-side horizontally and respectively defined by receptacle walls. Each connector receptacle has a first engagement feature for interferingly engaging a second engagement feature of a respective connector pin seated therein. The combination of the first and second engagement features collectively provide a primary lock for primarily retaining each connector pin in its respective connector receptacle.

The connector pins have an abutment feature for secondarily restraining it from axial movement in the connector receptacle in response to a tip of a button lock being received into the respective connector receptacle. In this regard, an upper side of the connector body is provided with a plurality of button ports, one button port respectively for each connector receptacle, wherein the respective button lock enters therethrough and the tip thereof interferingly engages the abutment feature. The combination of the button lock and the abutment feature collectively provide a secondary lock for secondarily retaining each connector pin in its respective connector receptacle.

The snap rail according to the present invention is pivotally connected to the upper side of the connector body transversely in relation to the orientation of the connector receptacles. The snap rail is integrally formed of the connector body, whereby pivoting is accomplished by flexing of a plurality of pivot arms. Each of the button locks is connected to the snap rail so that the tip thereof adjoins its respective button port when at an undeployed state of operation, and is fully received thereinto when at a deployed state of operation.

According to the preferred embodiment of the snap rail, a depression pad is provided at a central portion thereof for a user to press upon and thereby simultaneously press all the button fingers fully into their respective button ports. Further according to the preferred embodiment, each finger button adjacent the depression pad interferingly engages the connector body to thereby lock the snap rail in the deployed state of operation, wherein the remaining button fingers do not engage the connector body.

Accordingly, it is an object of the present invention to provide a snap rail for a connector body, wherein the rail unites a plurality of button fingers so that all are operatively deployed simultaneously.

It is an additional object of the present invention to provide a snap rail for a connector body, wherein one tool is used for manufacture and no side coring is required in the tool.

These, and additional objects, advantages, features and benefits of the present invention will become apparent from the following specification.

DESCRIPTION OF THE PREFERRED EMBODIMENT

Figure 1:
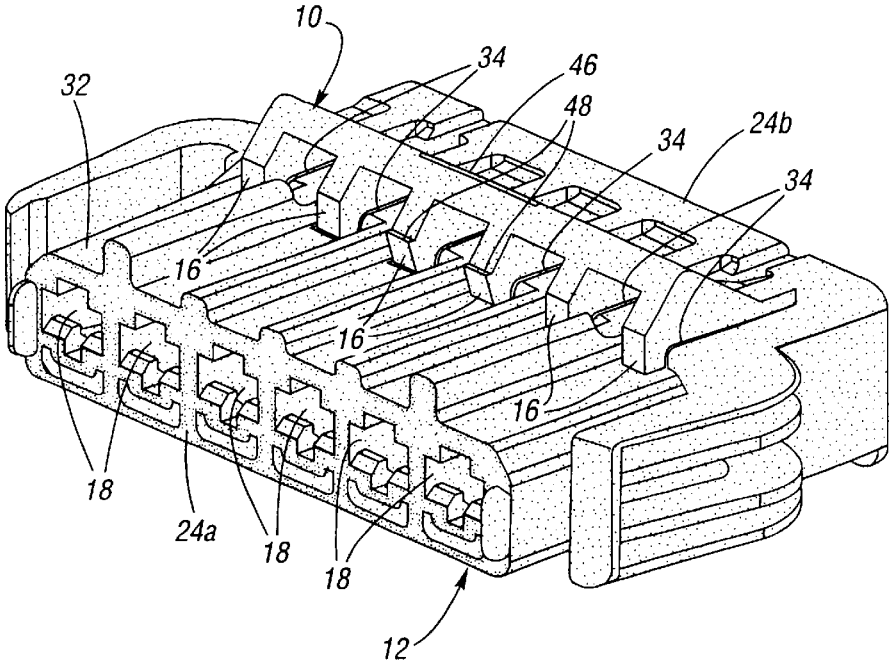
FIG. 1 is a perspective view of the forward end of a connector body equipped with the snap rail according to the present invention, wherein the snap rail is shown at an undeployed state of operation.
Figure 2:
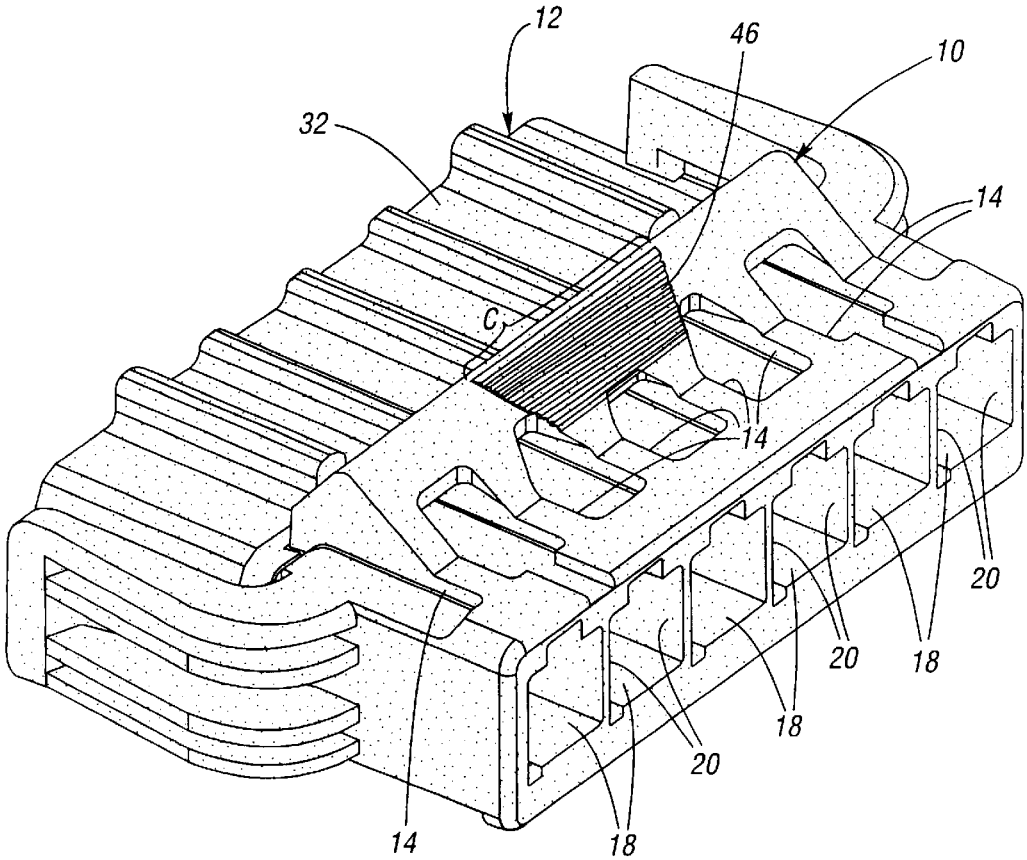
FIG. 2 is a perspective view of the rearward end of the connector body equipped with the snap rail of FIG. 1.
Figure 3:
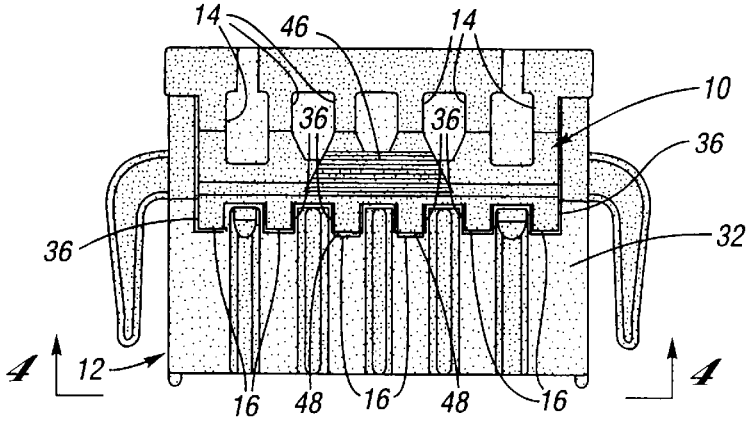
FIG. 3 is a top plan view of the connector body equipped with a snap rail of FIG. 1.
Figure 4:
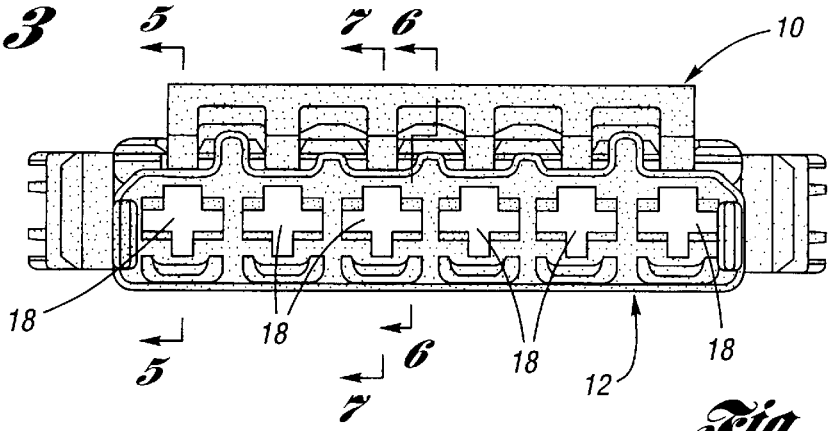
FIG. 4 is a front end view of the connector body equipped with the snap rail of FIG. 1.
Figure 5:
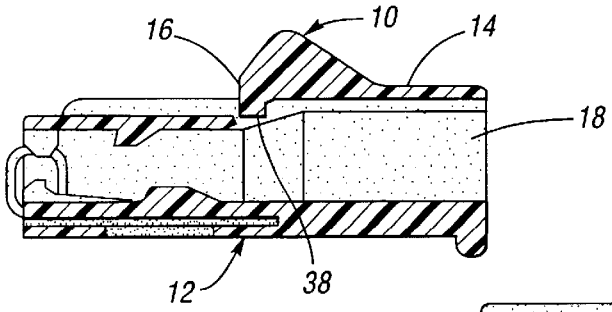
FIG. 5 is a partly sectional side view, seen along line 5—5 of FIG. 4.
Figure 6:
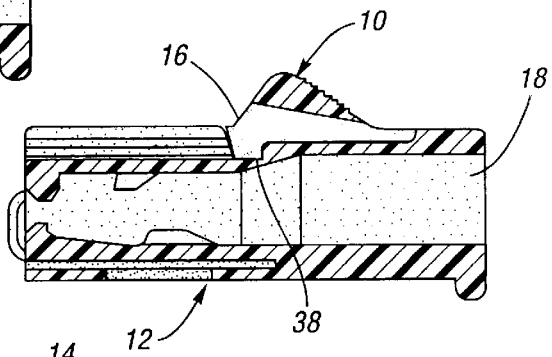
FIG. 6 is a partly sectional side view, seen along line 6—6 of FIG. 4.
Figure 7:
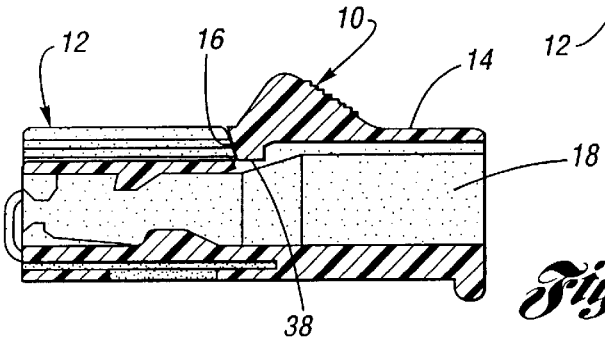
FIG. 7 is a partly sectional side view, seen along line 7—7 of FIG. 4.
Figure 8:
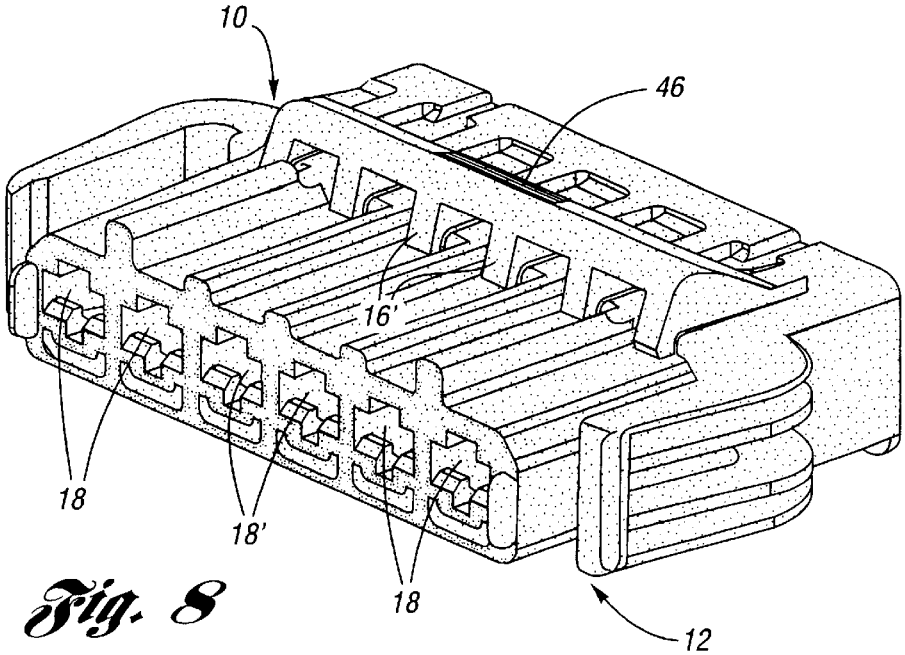
FIG. 8 is a perspective view of the forward end of a connector body equipped with the snap rail according to the present invention, wherein now the snap rail is shown at a deployed state of operation.

Referring now to the Drawings, FIGS. 1 through 4 and 8 generally depict a snap rail 10 according to the present invention integrally connected with a connector body 12, wherein FIGS. 1 through 4 show the snap rail in an undeployed state of operation and FIG. 8 shows the snap rail in a deployed state of operation. The snap rail 10 is pivotally and integrally connected to a connector body 12 via a plurality of pivot arms 14. Deployment of the snap rail 10, by its depression relative to the connector body 12, provides simultaneous actuation of a plurality of button locks 16 into respective connector receptacles 18 of the connector body.

The connector body 12, according to a preferred form of the present invention, has formed therewithin a plurality of discrete connector receptacles 18 arranged side-by-side, mutually separated by receptacle walls 20, and extending from the forward end 24*a* to the rearward end 24*b* of the connector body. Each connector receptacle 18 is dimensioned to seatably receive therein a respective connector pin 22 (see FIGS. 9 and 10). Further, each connector receptacle 18 has a first engagement feature 26 for interferingly engaging a second engagement feature 28 of the respective connector pin 22 seated therein (see FIGS. 9 and 10). The combination of the first and second engagement features 26, 28 collectively provide a primary lock 30 for primarily retaining each connector pin in its respective connector receptacle. The snap rail 10 according to the present invention is pivotally connected to the upper side 32 of the connector body 12 via the aforementioned plurality of pivot arms 14, wherein one respective pivot arm is located at each respective connector receptacle 18. The snap rail 10 is oriented transversely in relation to the orientation of the connector receptacles 18 (ie., parallel with the forward and rearward ends of the connector body 12). The snap rail is integrally formed of the connector body via the pivot arms 14, whereby the pivot arms serve as a robust multicomponent living hinge between the snap rail and the connector body. A slot 34 is formed in the upper side 32 of the connector body at each pivot arm 14 which communicates with respective connector receptacles 18. A forward end of each slot 34 provides a button port 36.

The plurality of button locks 16 are connected to the snap rail 10, and project normally therefrom so that a tip 38 of each button lock adjoins its respective button port 36 when the snap rail 10 is at the undeployed state of operation, and each button lock is fully received thereinto when the snap rail is at the deployed state of operation.

Each connector pin 22 has an abutment feature 40 for secondarily restraining it from axial movement in its respective connector receptacle 18 in response to a tip 38 of a button lock 16 being received into the respective connector receptacle through its respective button port 36, wherein the tip 38 interferingly engages the abutment feature. The combination of the tip 38 of the button lock 16 and the abutment feature 40 collectively provide a secondary lock 44 for secondarily retaining each connector pin 22 in its respective connector receptacle 18.

Figure 9:
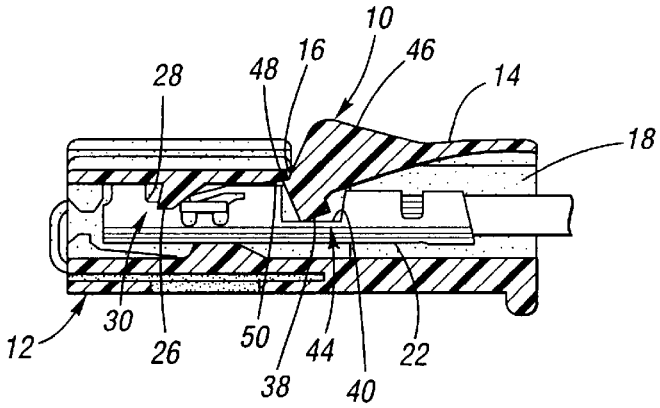
FIG. 9 is a partly sectional side view as in FIG. 7, wherein now the snap rail is in its deployed state of operation.
Figure 10:
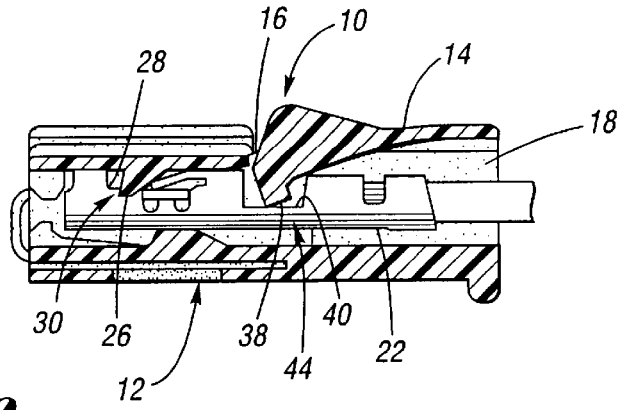
FIG. 10 is a partly sectional side view as in FIG. 5, wherein now the snap rail is in its deployed state of operation.

A depression pad 46 is preferably provided at a central portion C of the snap rail 10 (for example, the central portion C may extend over a center one third of the snap rail) so that a user may press thereupon to pivot the snap rail from the undeployed state of operation (see FIG. 1) to the deployed state of operation (see FIG. 8). As the snap rail 10 pivots from the undeployed state of operation to the deployed state of operation, all the button locks 16 simultaneously enter into their respective button ports 36. In concert with the depression pad 46, it is also preferred for each finger button 16 adjacent the depression pad to snappingly engage the connector body 12 to thereby lock the snap rail 10 at the deployed state of operation (see FIG. 9). The remaining button fingers 16 freely pass through their respective button ports 36 and do not engage the connector body 12, thereby minimizing force necessary to achieve the interference fit and limiting this force to the central portion C of the snap rail 10 (see FIG. 10). As shown at FIG. 8 by way of example, connector receptacles 18' are associated with button locks 16' having a lip 48. The connector receptacles 18 (including at least connector receptacles 18'), as best shown at FIG. 10, have an acute recess 50 formed adjoining the button port 36, wherein the lip 48 (of those button locks having a lip) snaps thereinto when the snap rail 10 is in the deployed state of operation.

In operation, with the snap rail at the undeployed state of operation, the connector pins 22 are seated, respectively, into the connector receptacles and primarily locked therein by the primary lock 30. Now the snap rail 10 is pressed upon at the depression pad 46, thereby causing the snap rail to pivot on the pivot arms from the undeployed state of operation to the deployed state of operation. As depicted at FIGS. 9 and 10, the tips of the button locks interferingly engage the abutment feature 40 of the connector pins to thereby secondarily lock them. As shown at FIG. 9, those button locks 16' having the lip 48 will interferingly engage the acute recess 50 to thereby lock the snap rail at the deployed state of operation.

It is to be understood that the configuration of the integral snap rail 10 and connector body 12 allows for a single tool for injection molding, wherein the mold draw is in a direction parallel to the orientation of the connector receptacles (ie., away from the forward and rearward ends of the connector body). As a result, no side coring is required in the tool. Further, the snap rail requires little space in the tool, and the small displacement of the snap rail between the undeployed state of operation to the deployed state of operation has the potential to reduce wiring harness manufacturing costs.

To those skilled in the art to which this invention appertains, the above described preferred embodiments may be subject to change or modification. Such change or modification can be carried out without departing from the scope of the invention, which is intended to be limited only by the scope of the appended claims.

What is claimed is:

1. A snap rail and connector body combination comprising:

a connector body having an upper side, a forward end and a rearward end, said connector body having a plurality of connector receptacles located between said forward and rearward ends, each connector receptacle having a respective button port formed in said upper side communicating therewith;

a snap rail located at said upper side of said connector body in transverse relation to said plurality of connector receptacles;

pivot arm means for integrally connecting said snap rail to said connector body, wherein said snap rail is pivotal via said pivot arm means between an undeployed state of operation to a deployed state of operation;

a plurality of button fingers connected to said snap rail wherein a button finger is respectively provided for each connector receptacle, each button finger having a tip wherein said tip is received into its respective connector receptacle when said snap rail is at said deployed state of operation, said plurality of button fingers comprising a first set of button fingers and a second set of button fingers, said second set of button fingers comprising a majority of the button fingers of said plurality of button fingers; and snap means interacting between said first set of button fingers and said connector body for retaining said snap rail at said deployed state of operation, wherein said snap rail has a central portion, wherein said first set of button fingers is located at said central portion, wherein said second set of button fingers is located outside said central portion and is free of said snap means, and wherein when said snap rail is at said deployed state of operation said snap means in combination with said snap rail causes each button finger of said plurality of button fingers to be simultaneously received into its respective connector receptacle, thereby minimizing force necessary to achieve an interference fit therebetween.

2. The snap rail and connector body of claim 1, wherein said central portion extends substantially over a center one third of said snap rail; wherein each said button finger has a forward end opposite said pivot arm means; and wherein said snap means comprises each button finger of said first set of button fingers having a respective lip at said forward end thereof.

3. The snap rail and connector body of claim 2, wherein said snap means comprises:

a lip located on each button finger at said central portion of said snap rail; and an acute recess at the button port of each connector receptacle respectively receiving each button finger at said central portion;

wherein when said snap rail is pivoted to said deployed state of operation, the lip of each button finger at said central portion is snappingly received into its respective acute recess.

4. The snap rail and connector body of claim 3, wherein said snap rail has a depression pad formed thereon at said central portion.

5. The snap rail and connector body of claim 2, wherein said upper side of said connector body has a plurality of slots wherein a slot is provided at each pivot arm, a forward end thereof forming said button port.

6. In a connector body comprising: a connector body having an upper side, a forward end and a rearward end, said connector body having a plurality of connector receptacles located between said forward and rearward ends, each connector receptacle having a respective button port formed in said upper side communicating therewith; an improvement thereto comprising:

a snap rail located at said upper side of said connector body in transverse relation to said plurality of connector receptacles;

pivot arm means for pivotally connecting said snap rail to said connector body, wherein said snap rail is pivotal between an undeployed state of operation to a deployed state of operation;

a plurality of button fingers connected to said snap rail wherein a button finger is respectively provided for each connector receptacle, each button finger having a tip wherein said tip is received into its respective connector receptacle when said snap rail is at said deployed state of operation, said plurality of button fingers comprising a first set of button fingers and a second set of button fingers, said second set of button fingers comprising a majority of the button fingers of said plurality of button fingers; and nap means interacting between said first portion of button fingers and said connector body for retaining said snap rail at said deployed state of operation, wherein said snap rail has a central portion, wherein said first portion of button fingers is located at said central portion, wherein said second portion of button fingers is located outside said central portion and is free of said snap means, and wherein when said snap rail is at said deployed state of operation said snap means in combination with said snap rail causes each button finger of said plurality of button fingers to be simultaneously received into its respective connector receptacle, thereby minimizing force necessary to achieve an interference fit therebetween.

7. The improvement of claim 6, wherein said central portion extends substantially over a center one third of said snap rail; wherein each said button finger has a forward end opposite said pivot arm means; and wherein said snap means comprises each button finger of said first set of button fingers having a respective lip at said forward end thereof.

8. The improvement of claim 7, wherein said snap means comprises:

a lip located on each button finger at said central portion of said snap rail; and an acute recess at the button port of each connector receptacle respectively receiving each button finger at said central portion;

wherein when said snap rail is pivoted to said deployed state of operation, the lip of each button finger at said central portion is snappingly received into its respective acute recess.

9. The improvement of claim 8, wherein said snap rail has a depression pad formed thereon at said central portion.

10. The improvement of claim 9, wherein said upper side of said connector body has a plurality of slots wherein a slot is provided at each pivot arm, a forward end thereof forming said button port; further wherein said snap rail is integrally connected to said connector body via said plurality of pivot arms.

* * * * *